US009079691B2

(12) United States Patent
Greene

(10) Patent No.: US 9,079,691 B2
(45) Date of Patent: Jul. 14, 2015

(54) WATERCRAFT UTILITY HARNESS

(71) Applicant: Daniel D. Greene, Monroe Township, NJ (US)

(72) Inventor: Daniel D. Greene, Monroe Township, NJ (US)

( * ) Notice: Subject to any disclaimer, the term of this patent is extended or adjusted under 35 U.S.C. 154(b) by 303 days.

(21) Appl. No.: 13/861,070

(22) Filed: Apr. 11, 2013

(65) Prior Publication Data

US 2013/0269587 A1 Oct. 17, 2013

Related U.S. Application Data

(60) Provisional application No. 61/624,669, filed on Apr. 16, 2012.

(51) Int. Cl.
*B63B 17/00* (2006.01)
*B65D 33/14* (2006.01)
*B65D 37/00* (2006.01)

(52) U.S. Cl.
CPC ..... *B65D 33/14* (2013.01); *B63B 17/00* (2013.01); *B65D 37/00* (2013.01); *B63B 2017/0054* (2013.01)

(58) Field of Classification Search
CPC B63B 17/00; B63B 2017/0054; B65D 33/14; B65D 37/00; B60R 2011/0059
USPC ..... 114/343, 364; 383/6–9, 16–24, 38–40; 224/400, 406, 407, 421, 314, 325, 326, 224/572
See application file for complete search history.

(56) References Cited

U.S. PATENT DOCUMENTS

| | | | | | |
|---|---|---|---|---|---|
| 2,106,405 | A | * | 1/1938 | Havemeyer | 383/41 |
| 3,014,759 | A | * | 12/1961 | Bing | 297/188.06 |
| 3,509,845 | A | | 5/1970 | Shimada | |
| 4,738,547 | A | * | 4/1988 | Brown | 383/39 |
| 4,756,455 | A | | 7/1988 | Kitner et al. | |
| 5,337,907 | A | * | 8/1994 | McKenzie et al. | 211/88.01 |
| 5,628,436 | A | | 5/1997 | Jones et al. | |
| 6,224,258 | B1 | | 5/2001 | Dodson | |
| 6,402,000 | B1 | * | 6/2002 | Stark | 224/572 |
| 6,994,050 | B2 | * | 2/2006 | Johnson et al. | 114/343 |
| 7,850,007 | B2 | | 12/2010 | Birds | |
| 2003/0218306 | A1 | | 11/2003 | Dixon et al. | |
| 2004/0020959 | A1 | | 2/2004 | Sellars | |

OTHER PUBLICATIONS

Blue Perfomance Bags (20 pgs).
RacerX Mariner Bags (5 pgs).

* cited by examiner

*Primary Examiner* — Ajay Vasudeva
(74) *Attorney, Agent, or Firm* — Gearhart Law, LLC

(57) ABSTRACT

A watercraft utility harness having a hanging piece and a utility pocket attached to the hanging piece. Separators may be disposed in the utility pocket to divide the utility pocket into sub-pockets that may house necessary items. There are attachment straps and flaps on the back of the hanging piece, allowing the watercraft utility harness to be hung on watercraft guardrail cords. There are front straps on the front side of the utility harness, preventing the items stored in the utility pocket from falling out. The utility harness is particularly suitable to store fuel containers and provide backup fuel supply for the watercraft. The utility pockets and sub-pockets may be sized specifically for this purpose.

20 Claims, 3 Drawing Sheets

WATERCRAFT UTILITY HARNESS

CLAIM OF PRIORITY

This application claims priority from U.S. provisional application 61/624,669, filed on Apr. 16, 2012, the contents of which are fully incorporated by reference.

FIELD OF THE INVENTION

The invention relates to a watercraft utility harness and more particularly relates to a watercraft utility harness that may be attached to boat guardrail cables to carry supplies such as fuel containers.

BACKGROUND OF THE INVENTION

Watercrafts, such as sailboats, fishing boats and yachts, are widely used for practical and entertaining purposes. It is desirable that the watercraft is capable of housing ample supplies such as fuel, drinkable water, and foodstuff to sustain a trip. However, due to limitations on board a watercraft, the ability to carry more supplies is in most occasions insufficient. In particular, having an extra supply of fuel, such as diesel, may enable the navigator to extend a trip and prepare for unanticipated conditions such as bad weather or accidents, thus improving the level of safety and enjoyment. Moreover, also due to the limited space on a watercraft, it is desirable to have a storing device that does not occupy too much space and that is easy to implement and access.

The current invention addresses such concerns by providing a watercraft utility harness that may be attached to the cables, especially the horizontal guardrail cables on a watercraft. Moreover, the utility harness introduced here may have broad usage aside from carrying supplies on a watercraft. With multiple advantageous designs in its attachment assembly and the materials used, the utility harness may be used in other environments as long as appropriate anchoring positions may be provided. In addition, the current invention provides the benefit of lightweight, portability, easy attachment, durability, and being inexpensive.

Some devices and systems have been developed for additional storage on a watercraft. These designs, however, show shortcomings in one aspect or another. For example, U.S. Pat. No. 4,756,455 discloses a utility saddlebag which has a top, sides, and ends and, of woven fabric attached together by seams of thread configured to cover the engine compartment enclosure of a jet-propelled watercraft. The saddlebag is held in place by the use of an elastic member sewn into a bead on the skirt or periphery of the device allowing it to be stretched over and held in place by tucking the ends under the edges of the housing. A number of pockets on the sides and on rear provide storage compartments, and strap assures closure on the sides. The invention provides storage for a watercraft, without any modification or alteration.

This design, however, requires the attachment of the saddlebag to the engine of the watercraft, making the usage of the saddlebag rather limited. Other various implements are also known in the art, but fail to address all of the problems solved by the invention described herein. The preferred embodiment of this invention is illustrated in the accompanying drawings and will be described in more detail herein below.

SUMMARY OF THE INVENTION

The present invention discloses a watercraft utility harness having a hanging piece and a utility pocket. The hanging piece has an upper edge, a front side and a back side. The utility pocket has a top opening, a front piece, a back piece, and side pieces. The back piece of the utility pocket is attached to the front side of the hanging piece. There are one or more front straps attached to the front side of the hanging piece and releasably connect to the front piece of the utility pocket. There is a back top flap having a top edge and a lower portion, the top edge being permanently attached to the back side of the hanging piece and the lower portion releasably attached to the back side of the hanging piece. Moreover, there are one or more back straps each having an upper point and a lower part, wherein the upper point is permanently attached to the back side of the hanging piece and the lower part of the first back strap is releasably connected to the back side of the hanging piece. When the front strap is connected to the front piece of the utility pocket, it partially covers the top opening of the utility pocket, preventing the items stored in the utility pocket from falling out.

The watercraft utility harness may be attached to the horizontal guardrail cables on a watercraft. In almost all the watercrafts, guardrail cables are used to serve as a fence at the edge of the watercraft and prevent accidental falling of persons or items into the water. The guardrail cables are attached to the guardrails and form horizontal barriers. The structure of the guardrails is generally robust and the guardrail cables are strong and well-positioned. These are the ideal places to hang extra supplies, especially when the proper devices like the utility harness introduced in the current invention are available.

In most occasions, there are two guardrails cables attached to the guardrails and these two cables are aligned horizontally parallel to the floor of the watercraft, with one cable positioned higher than the other. The back top flap of the hanging piece of the utility harness may embrace the upper guardrail cable when the lower portion of the back top flap is connected to the back of the hanging piece. Similarly, the back straps may embrace the lower guardrail cable when the lower parts of the back straps are connected to the back of the hanging piece. The back flap and back straps provide the support to hang the utility harness or at least anchor the utility harness by preventing it from falling down or tilting over. The two-guardrail-cable design is particularly suitable for the latter purpose. It should be noted that with proper selection of materials that make up the hanging piece and proper design for the thickness and robustness of the back flap and back straps, it is possible to hang the utility harness on a single guardrail cable. However, it is preferred to utilize both upper and lower guardrail cables to hang the utility harness.

The utility harness may be used to store anything. It is particular useful for the carrying and storing of watercraft supplies such as fuel, drinkable water, food stuffs, and safety devices. The specific design of the hanging piece and utility pocket may vary according to the type of watercraft and the items and substances that will be carried. For example, the utility harness may be designed specifically to carry fuel containers with a fixed size. The extra fuel may enable the user of the watercraft to prolong a trip and deal with unanticipated events such as bad weather and accidents.

The utility pocket may be used as a unitary structure, or it may be divided by separators into sub-pockets that may be individually useful for storing the same or different items. For example, two separators may be disposed in the utility pocket to divide it into three sub-pockets, with each sub-pocket being sized to carry a fuel container. The fuel container may have a handle and the front strap may be threaded under the handle before being attached to the front piece of the utility pocket, ensuring that the fuel container is firmly placed in each sub-pocket.

The hanging piece and utility pocket may be made from various kinds of materials. Preferably, the hanging piece and the utility pocket are made from lightweight materials that are robust and durable. Such a design not only improves the portability of the utility harness and makes the implementation particularly easy, but also ensures that the utility harness is safe, reliable, and may be used for a long period of time. In addition, it is preferable that the utility harness is made from waterproof and porous materials, preventing the accumulation of water in the utility pocket and preventing damping of the utility harness.

In general, the present invention succeeds in conferring the following, and others not mentioned, desirable and useful benefits and objectives.

It is an object of the present invention to provide a watercraft utility harness that is safe and easy to use.

It is another object of the present invention to provide a watercraft utility harness having multiple sub-pockets or compartments for storage.

It is another object of the present invention to provide a watercraft utility harness that may be easily attached to cables.

It is another object of the present invention to provide an embodiment of a watercraft utility harness that may be easily attached to the guardrail cables on a watercraft.

Yet another object of the present invention is to provide a watercraft utility harness that may be used to house one or more fuel containers.

Still another object of the present invention is to provide a watercraft utility harness that does not cause water accumulation.

It is another object of the present invention to provide a watercraft utility harness that is robust and durable.

Still another object of the present invention is to provide a watercraft utility harness that is inexpensive.

Still another object of the present invention is to provide watercraft utility harness having different sizes and dimensions to fit the needs for different watercrafts, different storing requirements and different conditions.

It is a further object of the invention to provide a watercraft utility harness that is easy to manufacture.

DESCRIPTION OF THE PREFERRED EMBODIMENTS

Figure 1:
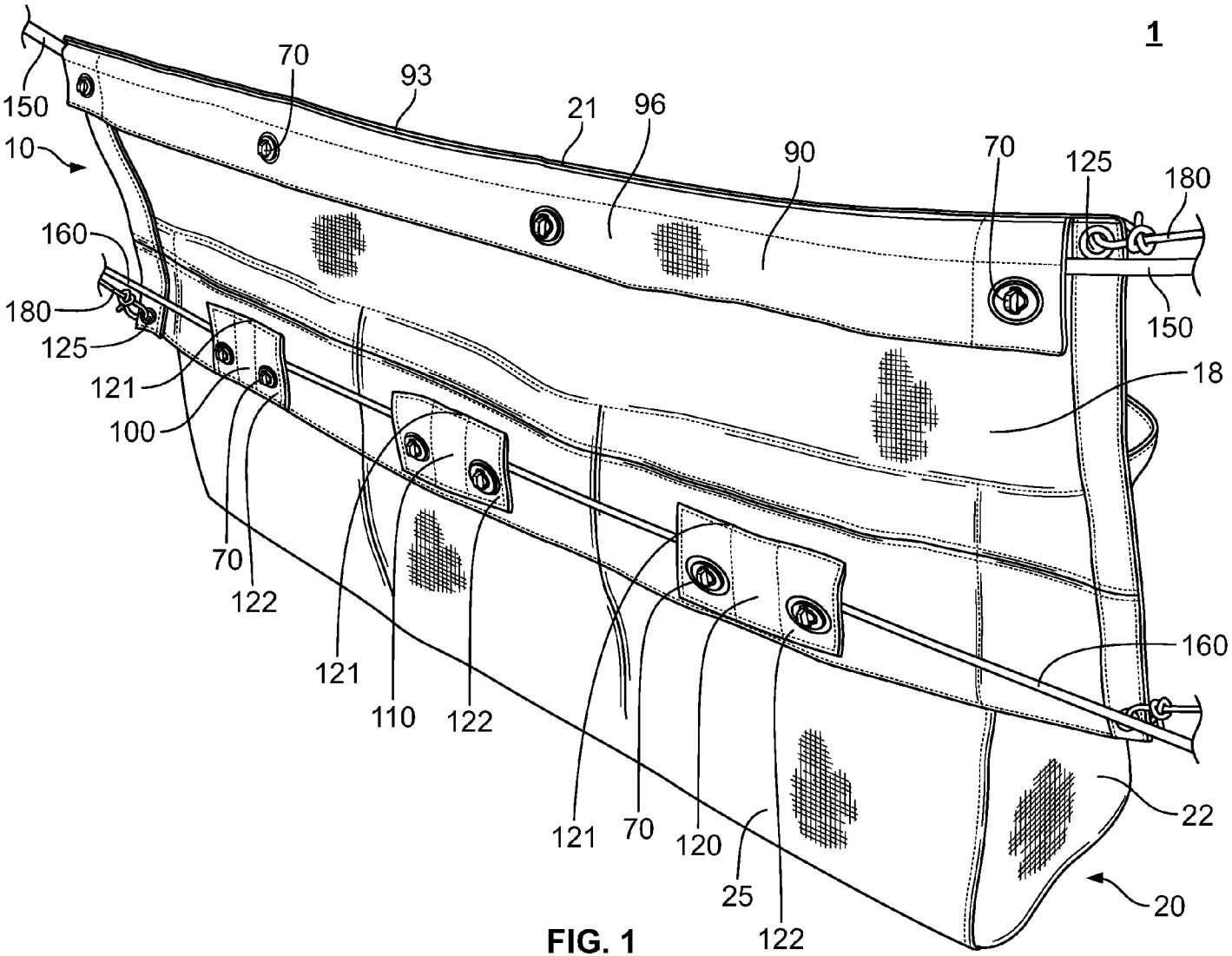
FIG. 1 shows a top back perspective view of a preferred embodiment of the watercraft utility harness when it is hung on the guardrail cables.

The preferred embodiments of the present invention will now be described with reference to the drawings. Identical elements in the various figures are identified, as far as possible, with the same reference numerals.

Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto without deviating from the innovative concepts of the invention.

FIG. 1 shows a top back perspective view of a preferred embodiment of the watercraft utility harness when it is hung on the guardrail cables. Shown in FIG. 1 is the watercraft utility harness 1 comprising a hanging piece 10 and a utility pocket 20; the hanging piece 10 has a back side 18 and an upper edge 21; the utility pocket 20 has a back piece 25 and side pieces 22. Also shown in FIG. 1 are the back top flap 90 having a top edge 93 and a lower portion 96, the top edge 93 of the back top flap 90 being aligned with and permanently attached to the upper edge 21 of the hanging piece 10 and the lower portion 96 of the back top flap 90 being releasably attached to the back side 18 of the hanging piece 10 with a plurality of snap fastener assemblies 70. In addition, FIG. 1 also shows a first back strap 100, a second back strap 110, and a third back strap 120, each having an upper point 121 and a lower part 122, the upper points 121 are permanently attached to the back side 18 of the hanging piece 10 and the lower parts 122 are releasably connected to the back side 18 of the hanging piece 10 with snap fastener assemblies 70. For clarity purposes, not all snap fastener assemblies 70 are marked.

"Permanent attachment," as used herein, refers to the type of attachments that may not be broken without damaging the integrity of the basic structures of the connecting mechanism or the parts being connected. On the other hand, a "releasable attachment" refers to an attachment that may be broken without the destruction of the connecting mechanism or the connected parts.

In FIG. 1, the watercraft utility harness 1 is hung on guardrail cables comprising an upper guardrail cable 150 and a lower guardrail cable 160. When the lower portion 96 of the back top flap 90 is connected to the back side 18 of the hanging piece 10, the back top flap 90 and the hanging piece 10 embrace the upper guardrail cable 150. Similarly, when the lower parts 122 of the back straps are releasably connected to the back side 18 of the hanging piece 10, the back straps and the hanging piece 10 embrace the lower guardrail cable 160. These structures provide the necessary forces that hang the watercraft utility harness 1 on the guardrail cables. At the very least, even if the watercraft utility harness 1 is not fully suspended, the hanging piece 10, the back top flap 90, and back straps anchor the watercraft utility harness 1 and prevent it from fall down or tilting over.

In addition to the back top flap 90 and the back straps, there are anchoring holes 125 on the hanging piece 10, wherein attachment cords 180 may be used to thread through the anchoring holes 125 to provide more stability to the watercraft utility harness 1. Preferably, the anchoring holes 125 are located on the corners of the hanging piece 10, allowing easy access by the attachment cords 180, which may be connected to the guardrails or other stable structures on the watercraft.

Figure 2:
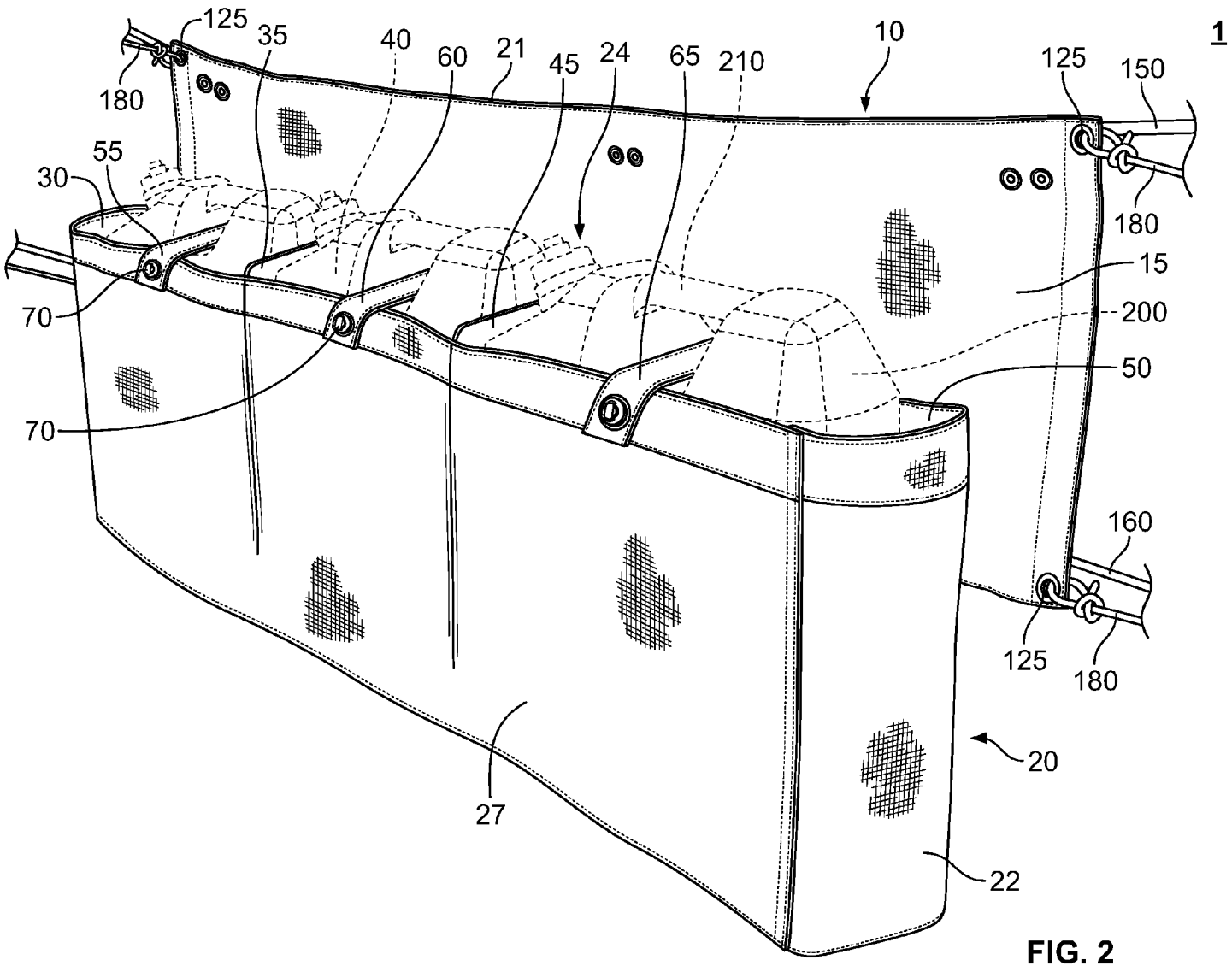
FIG. 2 shows a top front perspective view of a preferred embodiment of the watercraft utility harness when it is hung on the guardrail cables.

FIG. 2 shows a top front perspective view of a preferred embodiment of the watercraft utility harness when it is hung on the guardrail cables. Shown in FIG. 2 is the watercraft utility harness 1 having a hanging piece 10 and a utility pocket 20, wherein the hanging piece 10 has an upper edge 21 and a front side 15 and the utility pocket 20 has a top opening 24, a front piece 27 and side pieces 22. Also shown in FIG. 2 are a first front strap 55, a second front strap 60, a third front strap 65, with one end of the front straps being permanently attached to the front side 15 of the hanging piece 10 (not shown in FIG. 2) and the other end of the front straps being releasably attached to the front piece 27 of the utility pocket 20 with snap fastener assemblies 70. For clarity purposes, not all snap fastener assemblies 70 are marked. Also shown in FIG. 2 are the upper guardrail cable 150 and the lower guardrail cable 160 being used to hang watercraft utility harness 1, the anchoring holes 125 on the hanging piece 10 and the attachment cords 180 threaded through the anchoring holes 125. The basic usages of such structures are discussed above in FIG. 1.

In FIG. 2, the utility pocket 20 is divided by a first separator 35 and a second separator 45 into three sub-pockets. The first separator 35 and the second separator 45 are disposed in the utility pocket 20 and are generally parallel to the side pieces 22, dividing the utility pocket 20 into a first sub-pocket 30, a second sub-pocket 40, and a third sub-pocket 50. Three fuel containers 200 are kept in the three sub-pockets. Each fuel container 200 has a handle 210 and the front straps thread under the handles 210 to connect to the front piece 27, ensuring that the fuel containers are properly secured in the utility pocket 20.

It should be noted that the utility pocket 20 does not necessarily have to be separated, nor is it paramount that the utility pocket 20 be divided into three sub-pockets. The utility pocket 20 may be a single pocket or it may be divided into two or more sub-pockets having similar or different sizes and locations. The compartmentalization of the utility pocket 20 may be adjusted according to the size and weight of the supplies to be carried, the durability of the guardrails and cables, and the actual necessities of the user.

The key function of the front straps is to prevent whatever that is stored in the utility pocket to fall out. The possible tumultuous environment a watercraft may encounter, such as storms and heavy rain, requires that some enclosing mechanism be employed to secure the storage in the utility pocket. However, the design shown in FIG. 2 is not the only possibility. The precise format of the enclosing mechanism may be altered according to the specific needs of the user and the likelihood of falling out. For example, a cover completely enclosing the top opening 24 of the utility pocket 10 may be used to ensure full closure.

In terms of materials, the hanging piece 10 and the utility pocket 20 may be made from the same or different materials. More particularly, the various components of the watercraft utility harness may be made from the same or different materials. The materials that may be used include but are not limited to: metal, rubber, and plastic such as, but not limited to, polyethylene (PE), high-density polyethylene, polyvinyl chloride (PVC), polyvinylidene chloride (PVDC), low-density polyethylene (LDPE), polypropylene (PP), polystyrene (PS), polyesters, vinyl, (HIPS) and polycarbonate (PC), mesh fabric, or paperboard coated with a suitable waterproof coating such as, but not limited to, polyethylene, or some combination thereof. The material is preferred to be safe, strong, flexible, and waterproof. Moreover, it would be desirable that the material is inexpensive and easy to manufacture.

It is preferred that the utility pocket 20 is made porous so that water does not accumulate in the utility pocket 20. Due to waves, splashes, and rain, it is very likely that water may get access to the utility pocket 20 when the utility harness is installed on a watercraft. However, the accumulation of water may cause deterioration of the substances stored in the utility pocket 20. Moreover, the accumulated water adds to the weight that needs to be sustained by the hanging piece, making it more likely to collapse. Therefore, it is preferred that the utility pocket 10 is made from porous material. The preferred material for the hanging piece and utility pocket is Phifertex® mesh fabrics.

The dimension of the utility harness may be adjusted according to the supplies being carried, the necessities of the user, and the actual conditions likely to be encountered. The variations for the dimensions of the components of the utility harness are almost limitless. As shown FIG. 1 and FIG. 2, this particular preferred embodiment is designed to carry fuel containers. The width, height, and depth of the sub-pocket here may range from 1 to 100 inches (2.5-2500 cm), with the dimension of approximately 13×16×8 inches (33×40×20 cm). As shown in FIG. 2, the fuel containers 200 have container handles 210 that are exposed. The front straps may be threaded under the container handles 210 to ensure that the containers are properly secured.

As to the size of the hanging piece 10 and the utility pocket 20 as a whole, there are also many variations. It is preferred that the width of the hanging piece 10 is similar to, but not smaller than the width of the utility pocket 20. In the preferred embodiment, the width of the hanging piece 10 and the utility pocket 20 may range from 5-100 inches (12.5 to 1250 cm), with the preferred width to be approximately 50 inches (127 cm). The space between the back strap and the back flap is another essential dimension of the utility harness. In particular, it is preferred that the distance between the top edge 93 of the back flap 90 and the first point 121 of the back straps is similar to the distance between the top guardrail cable 150 and the bottom guardrail cable 160. With such a design, both the back straps and back flap structures are put to use when the hanging piece is properly attached to the guardrail cables.

It should also be noted that although the preferred embodiment is designed to hang from guardrails cables on a watercraft, it is still possible that the utility harness introduced by the current invention may be hung on other structures on a watercraft. Moreover, it is also possible that the current invention be used in other settings not a watercraft. As long as the key structures are the same, the use of the utility harness may vary according to the user's needs.

Figure 3:
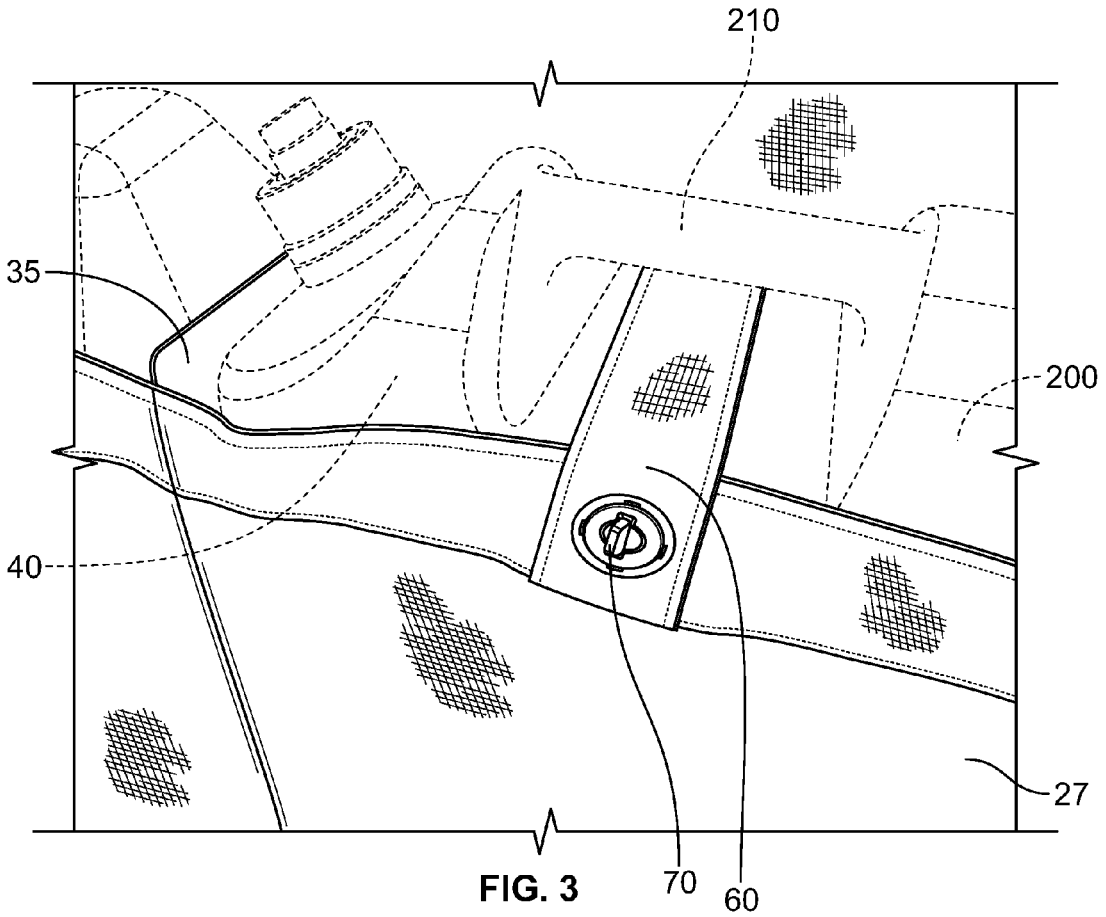
FIG. 3 shows a top front perspective view of a sub-pocket when a fuel container is stored therein.

FIG. 3 shows a top front perspective view of a sub-pocket when a fuel container is stored therein. Shown in FIG. 3 are the second sub-pocket 40, the first separator 35, the second front strap 60, the front piece 27 of the utility pocket 20, the snap fastener assembly 70, and the fuel container 200 having a handle 210, the fuel container 200 being stored in the second sub-pocket 40. FIG. 3 provides a more detailed depiction of how the fuel container 200 is being secured in the utility pocket 20.

Figure 4:
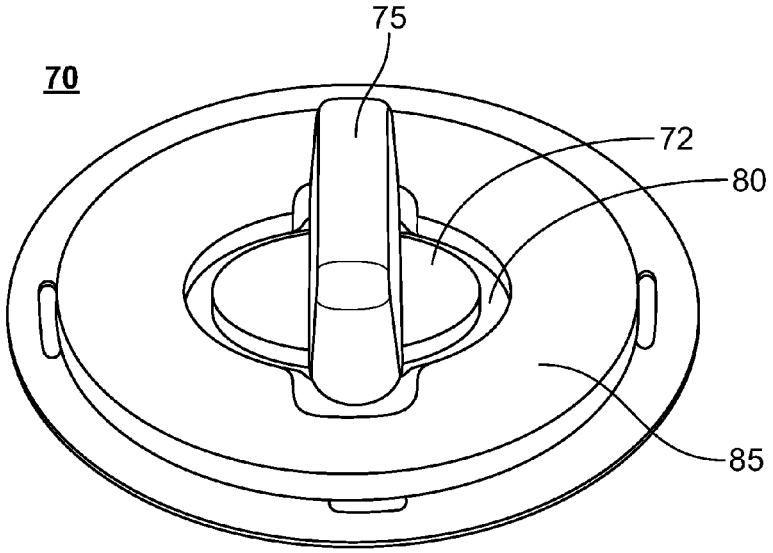
FIG. 4 shows a top front perspective view of the details of a snap fastener assembly.

FIG. 4 shows a top front perspective view of the details of a snap fastener assembly 70. The snap fastener assembly 70 shown here is just one of the possible ways to releasably attach the front straps to the front piece 27 of the utility pocket 20. It is also one of the many possible options to releasably attach the lower part 93 of the back flap 90 to the back side 18 of the hanging piece 10. Similarly, it is one of the options to releasably attach the second point 122 of the front straps to the front piece 27 of the utility pocket 20. Other possible options include but are not limited to: cross snaps, rivets, magnets, and hook-and-loop structures. Here in FIG. 4 the example demonstrates the snap fastener assembly 70 used to attach the second front strap 60 to the front piece 27.

As shown in FIG. 4, the snap fastener assembly 70 comprises an oval ring 85 encircling an oval opening 80, the oval ring 85 and the oval opening 80 are located on the second front strap 60 (not shown in FIG. 4). The snap fastener assembly 70 further comprises a fastening fin 75 rotatably disposed on a base platform 72, the base platform 72 being secured to the front piece 27 (not shown in FIG. 4). The length of the fastening fin 75 is shorter than the long diameter of the oval opening 80 but longer than the shorter diameter of the oval opening 80. Thus, the fastening fin 75 may be inserted through the oval opening 80 when the fastening fin 75 is aligned with the longer diameter of the oval opening. After insertion, the fastening fin 75 may be rotated to secure the fastening fin 75 on the oval ring 85.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A watercraft utility harness, comprising:

a hanging piece having an upper edge, a front side and a back side;

a utility pocket having a top opening, a front piece, a back piece, and side pieces;

wherein the back piece of the utility pocket is attached to the front side of the hanging piece;

a first front strap attached to the front side of the hanging piece;

a back top flap having a top edge and a lower portion, the top edge permanently attached to the back side of the hanging piece; and a first back strap having an upper point and a lower part, the upper point permanently attached to the back side of the hanging piece;

wherein the first front strap is releasably connected to the front piece of the utility pocket, partially covering the top opening of the utility pocket, the lower portion of the back top flap is releasably connected to the back side of the hanging piece, and the lower part of the first back strap is releasably connected to the back side of the hanging piece.

2. The watercraft utility harness of claim 1, wherein the back top flap is of an elongated shape and the top edge of the back top flap is aligned with the top edge of the hanging piece.

3. The watercraft utility harness of claim 1, wherein the back top flap embraces a watercraft guardrail cord when the lower portion of the back top flap is connected to the back side of the hanging piece, securing the watercraft utility harness on the watercraft guardrail cord.

4. The watercraft utility harness of claim 1, wherein the first back strap embraces a watercraft guardrail cord when the lower part of the first back strap is connected to the back side of the hanging piece, securing the watercraft utility harness on the watercraft guardrail cord.

5. The watercraft utility harness of claim 1, wherein the utility pocket is sized to house a fuel container.

6. The watercraft utility harness of claim 1, wherein the hanging piece and the utility pocket are made from waterproof materials.

7. The watercraft utility harness of claim 1, wherein the first front strap is releasably connected to the utility pocket with a snap fastener assembly, the lower portion of the top back strap is releasably connected to the back of the hanging piece with a snap fastener assembly, and the lower part of the back flap is releasably connected to the back of the hanging piece with a snap fastener assembly.

8. The watercraft utility harness of claim 1, wherein the utility pocket houses a stored item and the first front strap covers a top opening of the pocket and prevents the stored item from exiting the pocket.

9. The watercraft utility harness of claim 8, wherein the stored item is a fuel container.

10. The watercraft utility harness of claim 1, wherein the utility pocket is made from porous material allowing water to seep through.

11. The watercraft utility harness of claim 1, further comprising a first separator and a second separator disposed in the utility pocket and a second front strap and a third front strap attached to the hanging piece, wherein the first separator and the second separator are generally parallel to the side pieces and divide the utility pocket into a first sub-pocket, a second sub-pocket, and a third sub-pocket, the second front strap is releasably connected to the front piece, and the third front strap is releasably connected to the front piece, and the first front strap partially covers a top opening of the first sub-pocket, the second front strap partially covers a top opening of the second sub-pocket, the third front strap partially covers a top opening of the third sub-pocket.

12. The watercraft utility harness of claim 1, wherein the back top flap embraces an upper watercraft guardrail cord when the lower portion of the back top flap is connected to the back side of the hanging piece, the first back strap embraces a lower watercraft guardrail cord when the lower part of the first back strap is connected to the back side of the hanging piece, the back top flap and the first back strap suspend the watercraft utility harness on the watercraft guardrail cord.

13. A watercraft utility harness, comprising:

a hanging piece having an upper edge, a front side and a back side;

a utility pocket having a top opening, a front piece, a back piece, and side pieces;

wherein the back piece of the utility pocket is attached to the front side of the hanging piece;

a first separator and a second separator disposed in the utility pocket, wherein the first separator and the second separator are generally parallel to the side pieces and divide the utility pocket into a first sub-pocket, a second sub-pocket, and a third sub-pocket, a first front strap, a second front strap, and a third front strap attached to the front side of the hanging piece, wherein the first front strap, the second front strap, and the third front strap are releasably connected to the front piece, and the first front strap partially covers a top opening of the first sub-pocket, the second front strap partially covers a top opening of the second sub-pocket, the third front strap partially covers a top opening of the third sub-pocket, an elongated back top flap having an top edge and a lower portion, the top edge of the elongated back top flap being aligned to the upper edge of the hanging piece and permanently attached to the back side of the hanging piece; and a first back strap, a second back strap, and a third back strap each having an upper point and a lower part, the upper points being permanently attached to the back side of the hanging piece;

wherein the lower portion of the back top flap is releasably connected to the back side of the hanging piece, and the lower parts of the first back strap, the second back strap, and the third back strap, are releasably connected to the back side of the hanging piece.

14. The watercraft utility harness of claim 13, wherein the first sub-pocket, the second sub-pocket, and the third sub-pocket are sized to house a fuel container.

15. The watercraft utility harness of claim 13, wherein the back top flap embraces an upper watercraft guardrail cord when the lower portion of the back top flap is connected to the back side of the hanging piece, the first back strap, the second back strap, and the third back strap embrace a lower watercraft guardrail cord when the lower parts of the first back strap, the second back strap, and the third back strap are connected to the back side of the hanging piece, the back top flap, the first back strap, the second back strap, and the third back strap suspend the watercraft utility harness on the upper watercraft guardrail cord and lower watercraft guardrail cord.

16. The watercraft utility harness of claim 13, wherein the first sub-pocket, the second sub-pocket, and the third sub-pocket house diesel cans having handles, the first front strap, the second front strap, and the third front strap thread underneath the handles of the diesel cans to releasably attach to the front side of the hanging piece.

17. The watercraft utility harness of claim 13, wherein the utility pocket is made from porous material allowing water to seep through.

18. The watercraft utility harness of claim 13, wherein the utility pocket and the hanging piece are made from porous and waterproof material.

19. The watercraft utility harness of claim 13, wherein the first front strap, the second front strap, and third front strap are releasably connected to the utility pocket with snap fastener assemblies, the lower portion of the top back flap is releasably connected to the back of the hanging piece with snap fastener assemblies, and the lower parts of the first back strap, the second back strap, and the third back strap are releasably connected to the back of the hanging piece with snap fastener assemblies.

20. The watercraft utility harness of claim 13, wherein there are anchoring holes on the hanging piece and the hanging piece is anchored by attachment cords bonding the anchoring holes.

* * * * *